US005401194A

United States Patent [19]

Cornell

[11] Patent Number: 5,401,194

[45] Date of Patent: Mar. 28, 1995

[54] CABLE CLAMP WITH REDUCED FASTENER LENGTH

[75] Inventor: Paul A. Cornell, Knockamore, Isle of Man

[73] Assignee: Pan Electric Corporation, Carson City, Nev.

[21] Appl. No.: 195,261

[22] Filed: Feb. 14, 1994

[51] Int. Cl.[6] ..... H01R 4/40

[52] U.S. Cl. ..... 439/789; 439/838

[58] Field of Search ..... 439/789, 797, 798, 796, 439/828, 838, 863, 801, 810

[56] References Cited

U.S. PATENT DOCUMENTS

| | | | |
|---|---|---|---|
| 3,973,821 | 8/1976 | Scott et al. | 439/789 X |
| 3,980,381 | 9/1976 | Cornell | 439/789 X |
| 4,001,921 | 1/1977 | Lawlor et al. | 439/789 X |
| 4,014,078 | 3/1977 | Cornell et al. | 439/789 X |
| 4,357,068 | 11/1982 | Cornell et al. . | |
| 4,479,694 | 10/1984 | Cornell et al. . | |
| 4,548,462 | 10/1985 | Cornell . | |
| 4,898,551 | 2/1990 | Cornell . | |

*Primary Examiner*—David L. Pirlot
*Assistant Examiner*—Daniel Wittels
*Attorney, Agent, or Firm*—Willian Brinks Hofer Gilson & Lione

[57] ABSTRACT

A cable clamp includes first and second jaws, each having a respective cable clamping portion and tail. The first jaw is pivotably mounted to the second jaw to move between a cable receiving open position, in which a cable can be inserted between the cable clamping portions, and a cable clamping closed position, in which the cable is clamped between the cable clamping portions. A first opening is formed in one of the tails, and a raised boss is formed on the other of the tails. This raised boss is positioned to fit within the first opening when the jaws are in the closed position, and the raised boss includes a threaded opening. A threaded fastener is mounted in the threaded opening, and this threaded fastener applies closing forces on the tails as the threaded fastener is rotated into the threaded opening, thereby moving the jaws to the closed position.

15 Claims, 3 Drawing Sheets

CABLE CLAMP WITH REDUCED FASTENER LENGTH

BACKGROUND OF THE INVENTION

The present invention relates to cable clamps, in particular for use with electrical cables of the type generally used in electrical distribution networks.

In such networks it is known that ends of cables require connection in such a way as to provide a sound mechanical and electrical link between a cable and an external bar or plate, or alternately between two or more cables. Cables used in power distribution networks typically have stranded or solid cores of copper or aluminum and are generally of relatively large diameter and relatively difficult to work with.

It is also known to provide cable clamps which can be used to terminate a cable, for example to a bus bar, comprising a male jaw having a tail and an integral part-cylindrical head, and a female jaw having a tail and an integral yoke which defines a part-cylindrical socket. The head of the male jaw is received in the socket to permit relative pivotal movement between the jaws. A cable receiving opening extends diametrically through the head, and a cable receiving opening extends radially through the yoke. These openings are aligned in an open pivotal position of the jaws to permit insertion of the cable therethrough and substantially misaligned in a closed pivotal position of the jaws to clamp the cable. The tails are clamped together to hold the jaws in the closed position.

Cable clamps of this form are shown in Cornell U.S. Pat. No. 4,357,068, 4,479,694, 4,548,462 and 4,898,551 as well as in recently filed UK applications.

SUMMARY OF THE INVENTION

This invention provides an improvement for a cable clamp of the type comprising a first jaw having a first cable clamping portion and a first tail, and a second jaw having a second cable clamping portion and a second tail, in which the first jaw is pivotably mounted to the second jaw to move between a cable receiving open position, in which a cable can be inserted between the cable clamping portions, and a cable clamping closed position, in which the cable is clamped between the cable clamping portions.

According to this invention, a first opening is provided in one of the tails, and a raised boss is provided on the other of the tails, positioned to fit within the first opening when the jaws are in the closed position. The raised boss comprises a threaded opening, and a threaded fastener is mounted in the threaded opening. This threaded fastener is shaped to apply closing forces on said one of the tails as the threaded fastener is rotated into the threaded opening. These closing forces tend to move the jaws to the closed position.

In one preferred embodiment of the present invention, two pairs of jaws are provided in a connector for connecting two cables together. The two female jaws are formed back-to-back as an integral elongate unit, whereby the connector in use lies substantially along the longitudinal axis of two cables joined end to end. This embodiment also includes two male jaws, one for engagement with each of the female jaws. Separate fastening means may be provided for each pair of jaws, or it may be arranged that a single fastening means acts to secure two or more of the pairs.

There is consequently provided an in-line connector suitable for cables of the above types, which may be simply and easily installed without special tools and requiring little manipulation of the cable ends to be joined. The cable clamps described below provide high cable pull-out resistance and low electric resistance.

Because the raised boss extends up toward the opposed tail, a short threaded fastener or bolt can be used to close the cable clamp in many applications, without the need for special tools to pre-crimp the cable in the connector before the bolt is engaged. In this way, installation is made simpler, the need for special crimping or squeezing tools is reduced or eliminated, and the profile of the closed connector is reduced. This low-profile feature can eliminate protruding bolt ends when the clamp is closed, and makes it possible to use the clamp in in-line insulation equipment and in other situations. This low-profile advantage is also important in many other applications where space is limited, such as for switch gear equipment, panel boards, underground installations in insulated tubing, and the like.

The preferred embodiments of this invention provide the further advantage that the connector may be disconnected and re-connected as necessary.

BRIEF DESCRIPTION OF THE DRAWINGS

In order that the present invention may be better understood, preferred embodiments thereof will be described in the following by way of example and with reference to the accompanying drawings, in which.

DETAILED DESCRIPTION OF THE PRESENTLY PREFERRED EMBODIMENTS

Figure 1:
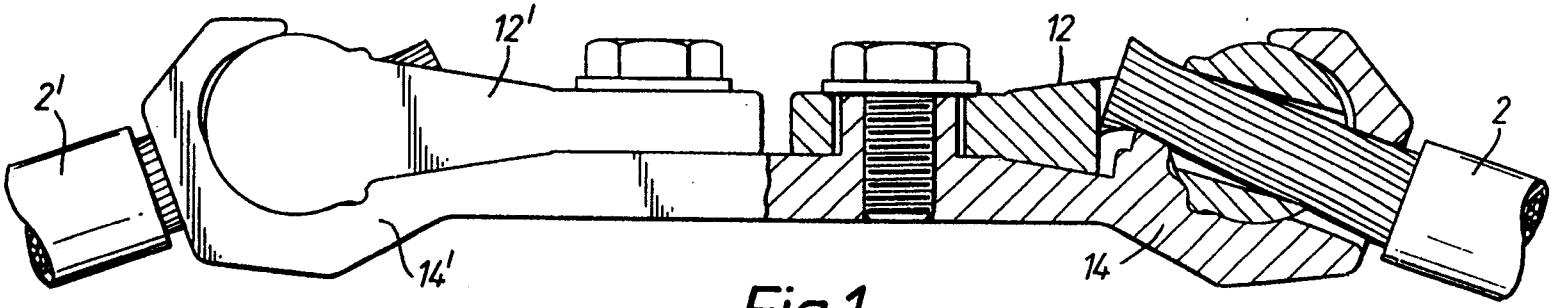
FIG. 1 shows a partially sectional view of a cable clamp according to a preferred embodiment of the present invention.

FIG. 1 shows a partially sectional view of a first preferred embodiment 10 of this invention, which enables the ends of two cables 2, 2' to be electrically and mechanically connected to each other. As may be appreciated from FIG. 1, this cable clamp 10 is symmetrical, having identical gripping mechanisms at each end, although in some embodiments the ends may be configured differently, and this will be discussed in detail later.

The detail of one end of the clamp 10 and the gripping of one cable 2 will be described, it being understood that the operation and construction of the other end is the same.

Figure 2:
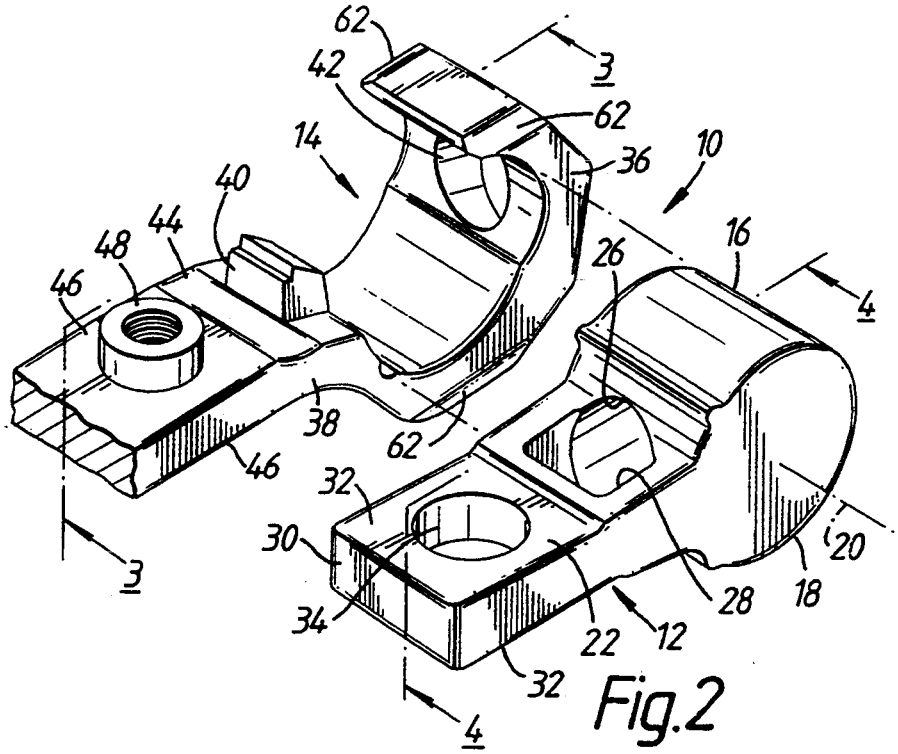
FIG. 2 is a perspective view of the preferred gripping mechanism included in the cable clamp of FIG. 1.

FIG. 2 shows a perspective view of the first end of the clamp 10 of FIG. 1 showing the gripping mechanism. As shown in FIG. 2, the gripping mechanism includes a male jaw or member 12 and a female jaw or member 14. The male jaw 12 is shown in greater detail in FIGS. 4 and 4*a*, and it includes a cylindrical head 16 which defines a cylindrical surface 18 centered on a cylinder axis 20 (FIG. 2). A first tail 22 extends radially away from the head 16, and the male jaw 12 is symmetrical about a plane of symmetry 24 (FIG. 4) which contains the cylinder axis 20.

Figure 4:
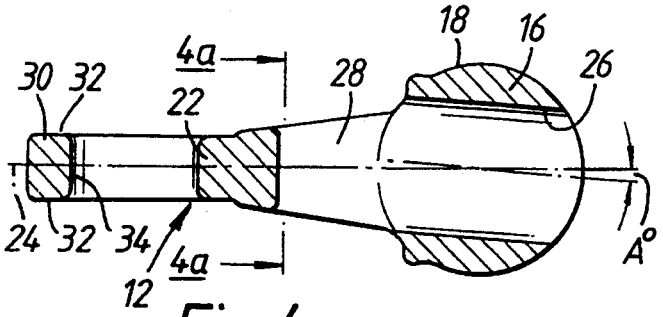
FIG. 4 is a sectional view taken along line 4—4 of FIG. 2.
Figure 4A:
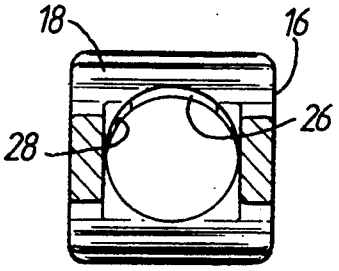
FIG. 4*a* is a sectional view taken along line 4*a*–4*a* of FIG. 4.

The male jaw 12 includes a first cable receiving opening 26 that, as shown in FIG. 4, is oriented at a skew angle A with respect to the first tail 22 and the plane of symmetry 24. The cable receiving opening 26 is adapted to receive the terminal portion of a cable, and the opening 26 opens out at both sides of the first tail 22 at a window 28 which passes completely through the tail 22.

The tail 22 defines a free end 30 and a pair of spaced, parallel, opposed first surfaces 32 adjacent the free end 30. Both of these first surfaces 32 are parallel to the plane of symmetry 24. A fastener receiving opening 34 extends completely through the first tail 22 and receives a fastener as described below.

Figure 3:
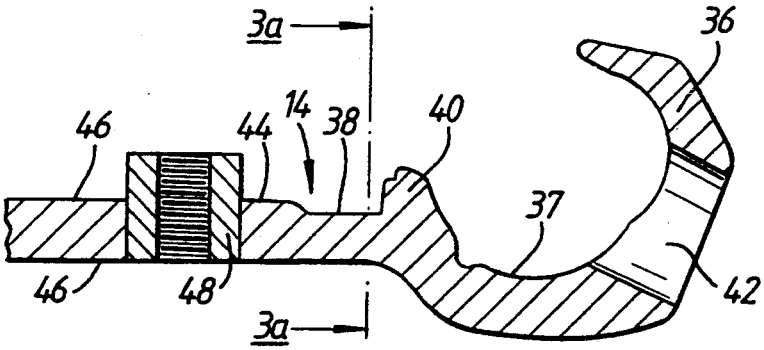
FIG. 3 is a sectional view taken along line 3–3 of FIG. 2.
Figure 3A:
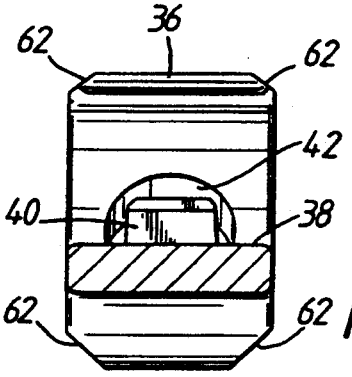
FIG. 3*a* is a sectional view taken along line 3*a*–3*a* of FIG. 3.

FIGS. 2, 3 and 3*a* provide a detailed illustration of the female jaw 14, which includes a head receiving portion or yoke 36 which is generally C-shaped and defines a part-cylindrical socket 37 sized to receive the cylindrical head 16 for rotation about the cylinder axis 20. The yoke 36 is integrally connected with a second tail 38 that includes a projection 40 positioned to extend into the window 28 when the first and second tails 22, 38 are clamped together.

A second cable receiving opening 42 extends through the yoke 36 and is positioned to align with the opening 26 when the jaws are in a cable receiving, open position, in which the first and second tails 22, 38 are separated from one another. The second tail 38 defines an intermediate portion 44, an end portion 45 and two opposed parallel second surfaces 46. A threaded boss or key 48 is fixed in an opening 51 passing through the intermediate portion 44 of the second tail 38 and is aligned with the opening 34 when the first and second tails 22, 38 are clamped together, such that the opening 34 fits over the upstanding part of the boss 48. Alternately, the boss 48 may be extruded as a ridge on the first tail 22 and subsequently machined to final shape. In practice, this approach is presently preferred.

Figure 5:
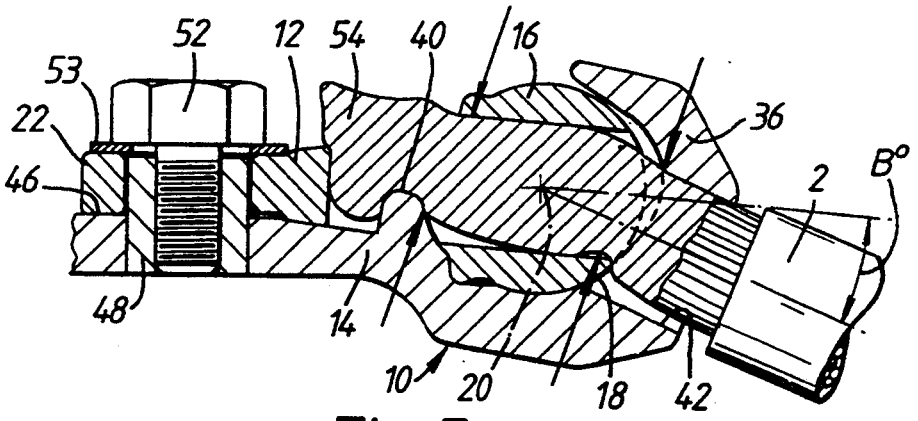
FIG. 5 is a sectional view of the preferred gripping mechanism configured to clamp a relatively larger cable.
Figure 6:
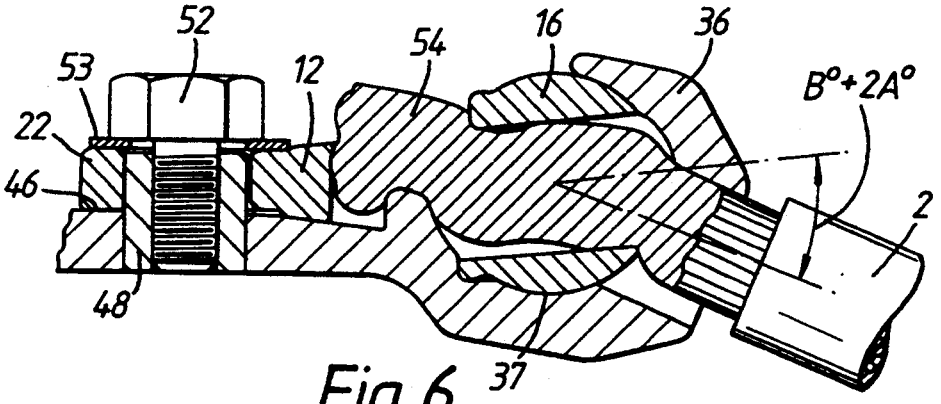
FIG. 6 is a view corresponding to that of FIG. 5 with the gripping mechanism configured to clamp a relatively smaller cable.

FIGS. 5 and 6 show the manner in which the gripping mechanism can be closed with a fastener 52 to clamp a cable. The fastener 52 clamps the first and second tails 22, 38 together to hold the jaws 12, 14 in the cable clamping, closed position.

In use, the fastener 52 is initially removed and the male jaw 12 is rotated to an open position (not shown) in which the first and second tails 22, 38 are spaced one from another. Then the terminal portion 54 of a cable 2 is inserted through the cable receiving openings 26, 42 until it abuts against the extreme end of the window 28. Then the male jaw 12 is rotated toward the closed position shown in FIGS. 4 and 5, and the fastener 52 is used to clamp the first and second tails 22, 38 together. This causes the projection 40 to enter the window 28 and the cable 2 to be gripped at four points as shown by the arrows in FIG. 5.

As shown in FIGS. 5 and 6, the jaws 12, 14 can be assembled in two different orientations to grip cables of two different diameters. In FIG. 5 the male jaw 121 is in a first orientation in which the angle B separates the open and closed positions. In FIG. 6 the male jaw 12 has been rotated by 180° about an axis of symmetry that is contained in the plane of symmetry 24 and is perpendicular to the cylinder axis 20. Because of the skew angle A shown in FIG. 4, in this alternate position the angular separation between the open and closed positions of the male jaw 12 is B+2A, and thus the gripping mechanism when assembled as shown in FIG. 6 operates to grip a smaller cable. In this regard, the gripping mechanism functions in a similar manner to the cable clamp described in detail in the above-identified Cornell patents.

The fastener 52 is in the form of a bolt 52 which passes through the opening 34 in the tail 22 of the male jaw 12 to engage with the threaded hole of the boss 48. As illustrated, a washer 53 may be included if necessary or desirable.

It is desirable that the bolt 52 should not protrude through the boss 48 in order to minimize the end-on profile of the assembled connector. During installation the tails must be closed, by some external force, sufficiently that the bolt 52 positioned through the opening 34 will reach and engage the thread of the opening of the boss 48. After such engagement the tails are closed further by tightening of the bolt. The provision of the upstanding boss 48 means that, for a given length of the bolt 52, the tails do not have to be closed as much as they would be in the absence of the boss 48 before the bolt 52 engages the thread. Alternatively, for a given possible amount of closure by the available external force, a shorter bolt 52 can be used to close the tails fully. In particular, the bolt 52 can be dimensioned to prevent it from protruding through the closed tails.

As is apparent from the drawings, the preferred arrangement is to provide a boss 48 which protrudes above the surface of tail 38 by an amount approximately equal to the thickness of the tail 22, and to use a bolt having a threaded shank length approximately equal to the combined thickness of the two tails.

As mentioned above, and as is apparent from FIG. 1, the clamp 10 according to this embodiment comprises two gripping mechanisms as described in detail with reference to FIGS. 2 to 6. Each of the male members may then be used in a separate one of the two orientations discussed above, whereby the connector can connect two cables of different diameters.

The cable receiving openings in one or both of the two gripping mechanisms may be shaped appropriately specifically for receiving and gripping one core of 119° solid sectoral cable. Such cable receiving openings are described in detail with respect to clamps in a recently filed UK patent application, Serial No. 930.5123.3 6 Feb. 1994.

As will be appreciated the cable clamp 10 provides a simple but highly effective way to connect cables. The ends of the cables simply need to be stripped of insulation, inserted into the cable receiving openings of the gripping mechanisms, and the pairs of jaws clamped together.

Of course such a cable clamp should preferably be insulated in many applications. This may be done simply by winding self-amalgamating insulating tape around the assembled cable clamp. The application of such an insulating cover may be facilitated by rounding the corners of the female jaws of the connector as indicated at 62 in FIGS. 2 and 3*a*. Such rounding of the corners also allows the clamp to fit in certain tubes and spaces limited in size by electrical codes, regulations, and usage.

In other embodiments, the cable clamp of the present invention may include three or more gripping mechanisms as described above, a first jaw of each gripping mechanism being formed as an integral unit with a first jaw of the others. This enables the connection of more than two cables.

Figure 7:
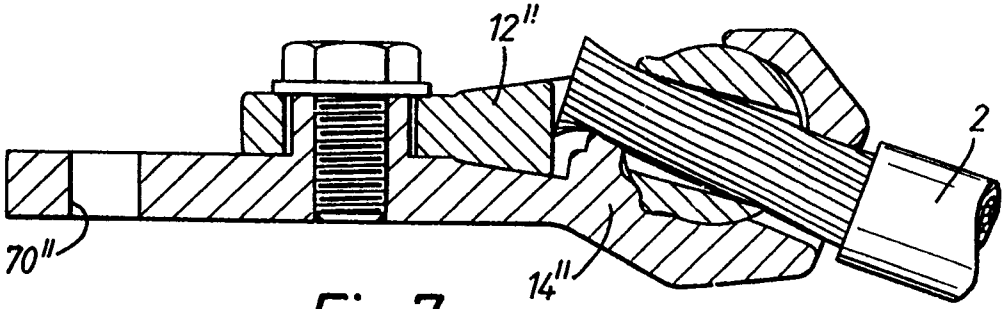
FIG. 7 is a cross sectional view of a second preferred embodiment of this invention.

In the clamp 10, the jaws 12',14' form an attachment structure which attaches the jaw 14 to the cable 2'. This attachment structure can take other forms, such as a further opening 70'' in one of the tails of the jaws 12'',14'' (FIG. 7). Such a further opening may receive a fastener that secures the jaw 12'',14'' to a bus bar or the like.

Of course, such a further opening may also be provided in one of the tails of the jaws 12, 12', 14'. This arrangement enables the cables to be connected to a bus bar or the like as well as to each other.

The components of the cable clamp 10 are preferably manufactured from an aluminum alloy having an electrical conductivity not less than 40% of the International Annealed Copper Standard. The cable receiving openings should preferably be sized approximately 110% of the largest cable to be clamped. In the case where all the major components of the connector have approximately constant cross-sectional shape, they are preferably machined from extruded stock.

Connectors according to the preferred embodiment of the present invention are capable of handling voltages up to 132 kV.

Of course, it should be understood that a wide range of changes and modifications can be made to the preferred embodiments described above. For example, the clamping arrangement can be varied to suit the application, and can if desired vary from the construction shown above. In fact, this invention can be readily adapted for use with a wide range of conventional cable clamping structures. It is therefore intended that the foregoing detailed description be regarded as illustrative rather than limiting, and that it be understood that it is the following claims, including all equivalents, which are intended to define the scope of this invention.

I claim:

1. In a cable clamp comprising:

a first jaw comprising a first cable clamping portion and a first tail;

a second jaw comprising a second cable clamping portion and a second tail;

said first jaw pivotably mounted to the second jaw to move between a cable receiving open position, in which a cable can be inserted between the cable clamping portions, and a cable clamping closed position, in which the cable is clamped between the cable clamping portions;

the improvement comprising:

a first opening in one of the tails; and a raised boss on the other of the tails positioned to fit within the first opening when the jaws are in the closed position, said raised boss comprising a threaded opening; and a threaded fastener mounted in the threaded opening, said threaded fastener shaped to apply closing forces on said one of the tails as the threaded fastener is rotated into the threaded opening, said closing forces tending to move the jaws to the closed position.

2. The invention of claim 1 wherein the boss is dimensioned not to protrude through the opening in said one of the tails when the second jaw is in the closed position.

3. The invention of claim 1 wherein the tails each define a respective thickness, and wherein the fastener comprises a threaded shank having a shank length substantially equal to the combined thickness of the first and second tails at the boss.

4. The invention of claim 1 wherein said first tail comprises an attachment structure, and wherein the threaded fastener is positioned between the attachment structure and the clamping portions.

5. The invention of claim 4 wherein the attachment structure comprises an opening formed in said first tail.

6. The invention of claim 4 wherein said attachment structure comprises:

a third jaw comprising a third cable clamping portion and a third tail;

a fourth cable clamping portion formed on said first tail;

said third jaw pivotably mounted to the fourth cable clamping portion to move between a cable receiving position and a cable clamping position, in which a second cable is clamped between the third and fourth cable clamping portions; and a second fastener secured between the third tail and said first tail to hold the third jaw in the cable clamping position.

7. The invention of claim 6 wherein the second fastener is received in a second threaded opening formed in a second boss, and wherein the second boss extends into an opening in the respective tail when the third jaw is in the cable clamping position.

8. The invention of claim 1 wherein the first clamping portion comprises a C-shaped element that defines a cylindrical socket, wherein the second clamping portion comprises a cylindrical head received in the cylindrical socket, and wherein the C-shaped element and the cylindrical head comprise respective cable receiving openings which are aligned when the jaws are in the open position and at least partially misaligned when the jaws are in the closed position.

9. The invention of claim 8 wherein the cylindrical head defines a plane of symmetry that passes through the second tail and a cylinder axis defined by the cylindrical head, and wherein the cable receiving opening in the cylindrical head is oriented at a skew angle with respect to the plane of symmetry such that the cylindrical head operates to clamp two different sizes of cable, one for each of two possible orientations of the cylindrical head in the C-shaped element.

10. The invention of claim 6 wherein the first and fourth clamping elements comprise respective C-shaped elements that define respective cylindrical sockets, wherein the second and third clamping portions comprise respective cylindrical heads received in the respective cylindrical sockets, and wherein the C-shaped elements and the cylindrical heads comprise respective cable receiving openings.

11. The invention of claim 10 wherein the cylindrical heads define respective planes of symmetry that each pass through the respective tail and cylindrical axis defined by the respective cylindrical head, and wherein the cable receiving openings in the cylindrical heads are oriented at skew angles with respect to the respective planes of symmetry, such that each of the cylindrical heads operates to clamp two different sizes of cable, one for each of two possible orientations of the respective cylindrical head in the respective C-shaped element.

12. An in-line cable clamp for clamping two cables together, said clamp comprising:

a first jaw having two opposed ends, said first jaw comprising a first C-shaped cable clamping portion at one end and a second C-shaped cable clamping portion at the other end, the first and second C-shaped cable clamping portions each comprising a respective cable receiving opening, the first jaw further comprising a central portion intermediate the opposed ends, said central portion comprising two raised bosses on a first side thereof, said bosses each comprising a respective threaded opening;

second and third jaws, each comprising a respective tail and a respective cylindrical head, each of the heads comprising a respective cable receiving opening and pivotally mounted in a respective one of the C-shaped cable clamping portions to move between a cable receiving position, in which the respective tail is spaced from the first side, and a cable clamping position, in which the respective tail is adjacent to the first side;

each of the tails comprising a respective opening sized to receive the respective boss when the respective head is in the cable clamping position; and first and second threaded fasteners, each engaged with a respective one of the threaded openings to bear on the respective tail to apply closing forces as the threaded fastener is rotated into the threaded opening, said closing forces tending to move the heads to the cable clamping position.

13. The invention of claim 12 wherein the bosses are dimensioned not to protrude through the openings in the tails when the cylindrical heads are in the cable clamping position.

14. The invention of claim 13 wherein the threaded fasteners are dimensioned not to protrude through the threaded openings when the cylindrical heads are in the cable clamping position.

15. The invention of claim 14 wherein the cylindrical heads each define a respective plane of symmetry that passes through a cylinder axis defined by the respective cylindrical head and the respective tail, and wherein the cable receiving openings in the cylindrical heads are oriented at skew angles with respect to the respective planes of symmetry, such that each of the cylindrical heads operates to clamp two different sizes of cable, one for each of two possible orientations of the respective cylindrical head in the respective C-shaped cable clamping portion.

* * * * *

UNITED STATES PATENT AND TRADEMARK OFFICE

CERTIFICATE OF CORRECTION

PATENT NO. : 5,401,194
DATED : March 28, 1995
INVENTOR(S) : Paul A. Cornell

It is certified that error appears in the above-indentified patent and that said Letters Patent is hereby corrected as shown below:

On the Title Page

In item [75] Inventor: delete
"Knockamore, Isle of Man" and substitute --Knockanore, Rep. of Ireland--.

Signed and Sealed this

Tenth Day of October, 1995

*Attest:*

*Attesting Officer*

BRUCE LEHMAN

*Commissioner of Patents and Trademarks*